US007273347B2

(12) United States Patent
Rathmann

(10) Patent No.: US 7,273,347 B2
(45) Date of Patent: Sep. 25, 2007

(54) BLADE FOR A GAS TURBINE

(75) Inventor: Ulrich Rathmann, Baden (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 11/549,767

(22) Filed: Oct. 16, 2006

(65) Prior Publication Data

US 2007/0071593 A1 Mar. 29, 2007

Related U.S. Application Data

(63) Continuation of application No. PCT/EP2005/051721, filed on Apr. 19, 2005.

(30) Foreign Application Priority Data

Apr. 30, 2004 (EP) ..... 04101876

(51) Int. Cl.
*F01D 5/18* (2006.01)
*F01D 25/12* (2006.01)

(52) U.S. Cl. ..... 415/173.6; 416/97 R

(58) Field of Classification Search ..... 416/97 R, 416/189; 415/173.1, 173.6, 115, 92
See application file for complete search history.

(56) References Cited

U.S. PATENT DOCUMENTS 3,606,574 A * 9/1971 Brands et al. ..... 416/96 R
4,311,431 A * 1/1982 Barbeau ..... 415/173.6
5,460,486 A 10/1995 Evans et al.
6,254,345 B1 * 7/2001 Harris et al. ..... 416/96 R
6,284,691 B1 * 9/2001 Bruce ..... 501/103
6,638,012 B2 * 10/2003 Bekrenev ..... 415/115
6,641,360 B2 * 11/2003 Beeck et al. ..... 415/1
7,104,751 B2 * 9/2006 Naik et al. ..... 415/116

FOREIGN PATENT DOCUMENTS

| | | |
|---|---|---|
| DE | 10336863 | 3/2005 |
| EP | 1013884 | 6/2000 |
| EP | 1041247 | 10/2000 |
| EP | 1083299 | 3/2001 |
| FR | 1163559 | 9/1958 |
| JP | 58047104 | 3/1983 |
| WO | WO2005/106208 | 11/2005 |

OTHER PUBLICATIONS

Search Report for EP Patent App. No. 04101876.3 (Oct. 6, 2004).
International Search Report for PCT Patent App. No. PCT/EP2005/051721 (Jul. 27, 2005).

* cited by examiner

*Primary Examiner*—Ninh H. Nguyen
(74) *Attorney, Agent, or Firm*—Cermak Kenealy & Vaidya LLP; Adam J. Cermak

(57) ABSTRACT

A gas turbine blade (1) has a shroud (3) which is cooled by different cooling mechanisms in various regions (A, B, C) according to the different thermal load. In a first region (A), in a fin (8), bores are provided, by which a convective cooling of the fin and a film cooling of the hot gas side of the fin are implemented. A second region (B) is cooled by impingement cooling by a cooling air stream from a duct in the radially opposite stator housing. A third region (C) has a plurality of bores running parallel which run from a cooling duct of a cooling system for the blade leaf to the radially outer surface of the shroud. A cooling air stream flowing through these bores causes a convective cooling of this region.

13 Claims, 4 Drawing Sheets

BLADE FOR A GAS TURBINE

This application is a Continuation of, and claims priority under 35 U.S.C. § 120 to, International application number PCT/EP2005/051721, filed 19 Apr. 2005, and claims priority therethrough under 35 U.S.C. § 119 to European application number No 04101876.3, filed Apr. 30, 2004, the entireties of which are incorporated by reference herein.

BACKGROUND OF THE INVENTION

1. Field of the Invention

The invention relates to a blade for a gas turbine and, in particular, to cooling for the shroud of the blade.

2. Brief Description of the Related Art

Shrouds for gas turbine blades serve for sealing and limiting the leakage flow in the gap region between the blade tips and the radially opposite stator or rotor. Such shrouds extend in the circumferential direction and, over a defined region, in the direction of the turbine axis, as far as possible so as to match the contour of the inner housing or of the rotor. For the purpose of improving the sealing, conventional shrouds in many instances also have one or more sealing ribs, also called fins, which run from a platform of the shroud, that is to say of an essentially flat portion of the shroud, along the radial direction.

For the purpose of prolonging their operating time in the gas turbine through which hot gas flows, the shrouds are cooled convectively, as disclosed, for example, in EP 1013884 and EP 1083299. These documents each describe a blade with a shroud which has a plurality of bores for a cooling air flow. The bores are connected to a cooling duct in the blade leaf and each lead to a lateral exit in the circumferential direction.

EP 1041247 discloses a gas turbine blade with inner radially cooling ducts which issue into a plenum 42 and 44. Bores 54, 56, 58 extend from there in the plane of the shroud, the shroud being cooled by means of film and convective cooling through the bores. In a variant, the bores extend from the plenum obliquely and in a slightly radial direction with respect to the radially outer surface of the shroud platform.

A shroud of a gas turbine blade is subjected to varying thermal load along the direction of flow of the hot gas and also, in various regions, to varying mechanical load. Consequently, the requirements for cooling and mechanical load-bearing capacity in various regions of the shroud are also different. This is taken into account, in the aforementioned gas turbine blades, by the matching of the bore diameters and other measures for changing the pressure differentials.

SUMMARY OF THE INVENTION

One aspect of the present invention includes providing a gas turbine blade with a cooled shroud, in which blade the different requirements, as regards cooling and mechanical load-bearing capacity in the various regions of the shroud are taken into account to an increased extent, in order to prolong the useful life and, as far as possible, reduce the cooling air consumption.

In an exemplary embodiment, the shroud of a gas turbine blade extends in the circumferential direction along the blade tip and in the radial direction with respect to the turbine rotor and is arranged opposite a stator housing. For efficient cooling corresponding to the thermal loads, the shroud is divided into regions which are subjected to different thermal load. According to the invention, the various regions are cooled by means of different cooling arrangements, each cooling arrangement allowing cooling with a different physical action adapted to the thermal load, such as, for example, film cooling, impingement cooling, convective cooling, or mixed cooling.

In a first version embodying principles of the present invention, the gas turbine blade has a first cooling arrangement for cooling a first region of the shroud by means of cooling air from a cooling system from inside the blade. This first region is the first region in the direction of the hot gas flow and is therefore subjected to the most thermal load. A second region downstream of the first region in the direction of the hot gas flow is subjected to lower thermal load in comparison with the first region. The second cooling arrangement is arranged at a stator arranged radially opposite the gas turbine blade and serves for cooling the second region of the shroud from outside the blade. The first and second cooling arrangements are different from one another in that the first cooling arrangement causes convective and film cooling and the second cooling arrangement causes impingement cooling. The cooling of the shroud has the effect of a cooling appropriate for the thermal load on the regions and of a correspondingly appropriate cooling air consumption.

In a preferred embodiment, the first region of the shroud of the gas turbine blade has, in particular, a fin which extends in a radial direction with respect to the gas turbine rotor and in its longitudinal direction runs in the circumferential direction and in which the first cooling arrangement is arranged. The fin has a plurality of bores which are flow-connected to a cooling duct of the blade leaf and have exits on the hot gas side of the shroud. A cooling air stream, during its flow through the bores, gives rise to a convective cooling of the fin. After its exit from the bores, it flows along the outer surface of the shroud and causes film cooling there.

The stator housing, which is arranged radially opposite the shroud, has a plurality of cooling ducts which are directed essentially perpendicularly to the platform of the shroud. They serve for cooling the second region of the shroud in the direction of flow of the hot gas. They are connected to the stator cooling system, with the result that cooling air branched off from the latter flows via the cooling ducts onto the platform of the shroud and causes impingement cooling there. The cooling air thereafter escapes in both axial directions, during which a blocking flow may occur in the opposite direction to the leakage flow. The second region of the shroud is limited in the axial direction, on both sides, by fins running radially.

In a further preferred version embodying principles of the present invention, the gas turbine blade has, in addition to the features of the first version, a further third region of the shroud in the direction of the hot gas flow, the third region being equipped with a third cooling arrangement. This cooling arrangement has a plurality of bores which are flow-connected to a cooling duct inside the blade leaf. The bores are directed in an at least partially radially outward direction at an angle to the radial and conduct a cooling air stream to the radially outer part of the shroud. Cooling air which flows through these bores gives rise to a convective cooling of this third region. In particular, the bores are oriented in the plane of the shroud platform at an angle with respect to the circumferential direction, in such a way that the cooling air is blown out of the bores essentially opposite to the direction of rotation of the blades.

In a particular version, the bores run parallel to one another in the end region.

In a further version, with regard to the gas turbine blade of the first version, a plurality of further cooling ducts are arranged in the stator located radially opposite the shroud and are directed essentially perpendicularly to a third region of the shroud in the direction of the hot gas flow. They serve for cooling this third region. The third region is limited in the axial direction and in the opposite direction to the hot gas flow by a fin. As in the first version, the cooling ducts are flow-connected to the cooling system of the stator, with the result that cooling air is directed out of the stator cooling system onto the end region of the shroud and causes impingement cooling there.

DETAILED DESCRIPTION OF EXEMPLARY EMBODIMENTS

Figure 1:
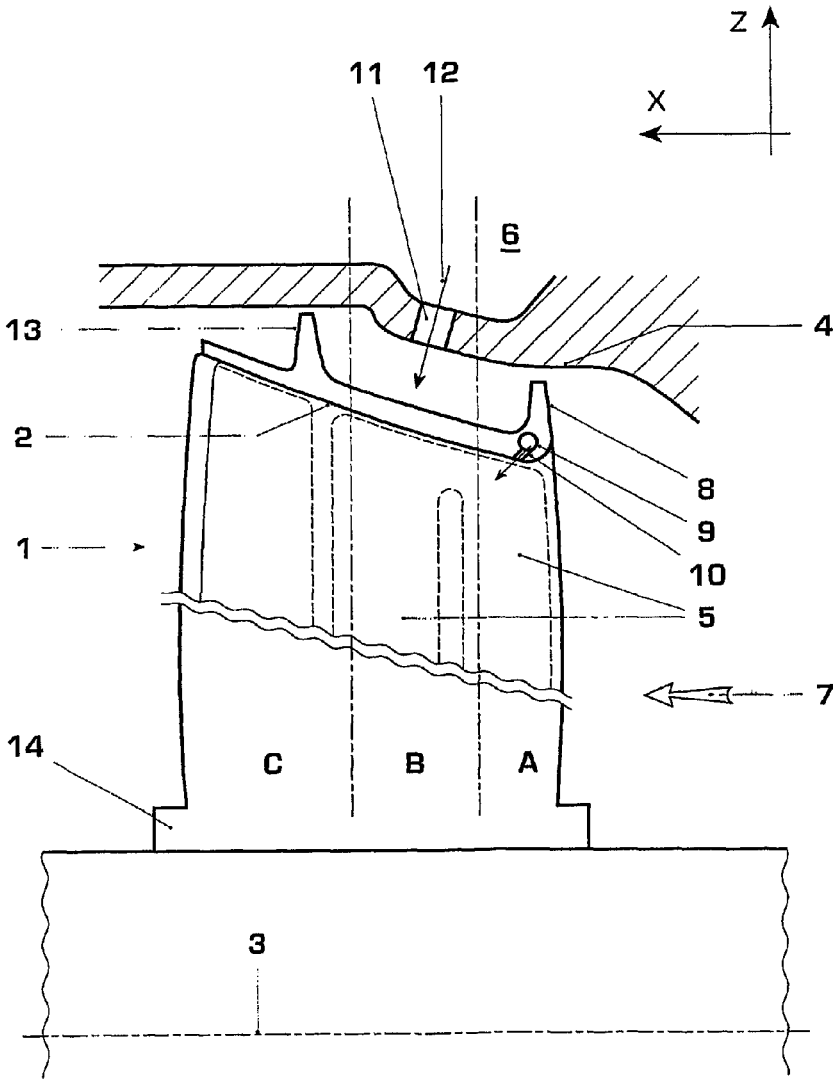
FIG. 1 shows a section through a rotating gas turbine blade and part of the opposite stator with a cooling arrangement according to the first and second versions of the invention.
Figure 3:
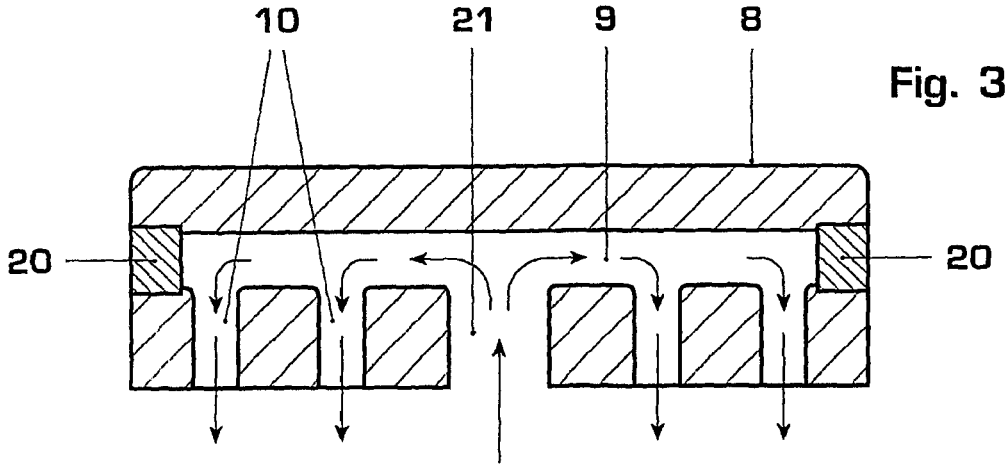
FIG. 3 shows a side view of the shroud along the sectional line III-III to illustrate the film cooling bores in the first region.

FIG. 1 shows a rotating gas turbine blade in a meridional section through the gas turbine. The directions x and z indicate, respectively, the axial direction, that is to say the direction of the machine axis, and the radial direction with respect to the gas turbine rotor. The blade leaf 1 and the blade tip, at which the shroud 2 is arranged, are shown. The stator housing 4 is shown opposite the shroud 2 in a radially outward direction with respect to the gas turbine rotor 3. The gas turbine blade and the stator housing in each case have a cooling system 5 and 6. The direction of the hot gas flow is identified by an arrow 7. Basically, the temperature of the hot gas flow and, correspondingly, the thermal load on the machine components decrease continuously along the direction 7. The shroud 2 is subdivided into three regions A, B, and C. The first region A is exposed to a higher temperature of the hot gas flow, as compared with the two following regions B and C, and is consequently subjected to the most thermal load. According to an exemplary embodiment of the invention, the first region has a fin 8 which extends radially outward and in the circumferential direction. The fin 8 has a bore 9 which is flow-connected to the cooling system 5. This bore extends, for example, in the circumferential direction within the fin. A plurality of further bores 10 branch off from this bore 9 and extend radially inward as far as an exit on the rotor-side surface of the fin, that is to say on the hot gas side of the shroud. The bores 10 branching off are illustrated in FIG. 3. Cooling air from the cooling system 5 of the blade leaf flows through the bore 9 and through the bores 10 branching off, said cooling air causing a convective cooling of the fin 8. The exits of the bores are in each case configured in such a way that emerging cooling air flows along the surface of the fin and causes additional film cooling there. The fin is thus cooled by two different cooling mechanisms.

A cooling duct 11, which is connected to the cooling system in the stator housing, is arranged, through the wall of the housing 4, opposite the second region B of the shroud 2. A cooling air stream, indicated by the arrow 12, flows from this cooling system through the cooling duct 11, and, by virtue of its orientation, is directed preferably perpendicularly to the shroud 2. Depending on the geometry of the turbine duct and of the shroud, the cooling duct 11 is also oriented at a different angle with respect to the shroud. The cooling air stream 12 thus gives rise to an impingement cooling of the middle region B of the shroud. The region B is limited in the axial direction and in the direction of the hot gas flow by the first fin 8 and a second fin 13. The cooling air stream 12 escapes from the limited region as a leakage flow, in that the cooling air stream flows away in both axial directions via the fin 8 and the fin 13. This may give rise, depending on the operating conditions, to a blocking flow counter to a hot gas leakage flow.

Normally, because of degradation effects, a mixed cooling of the shroud will in time occur.

Alternatively to this, in an advantageous embodiment, a special orifice or gap, allowing an exactly controlled outflow of the cooling air, is provided in the region of the second sealing fin 13.

According to a second exemplary version, in a further region C of the shroud, a plurality of bores are arranged which emanate from the cooling system 5 of the blade leaf and run to the radially outer surface of the shroud. A cooling air stream through these bores gives rise to a convective cooling of this region. They are illustrated in FIG. 2.

Figure 2:
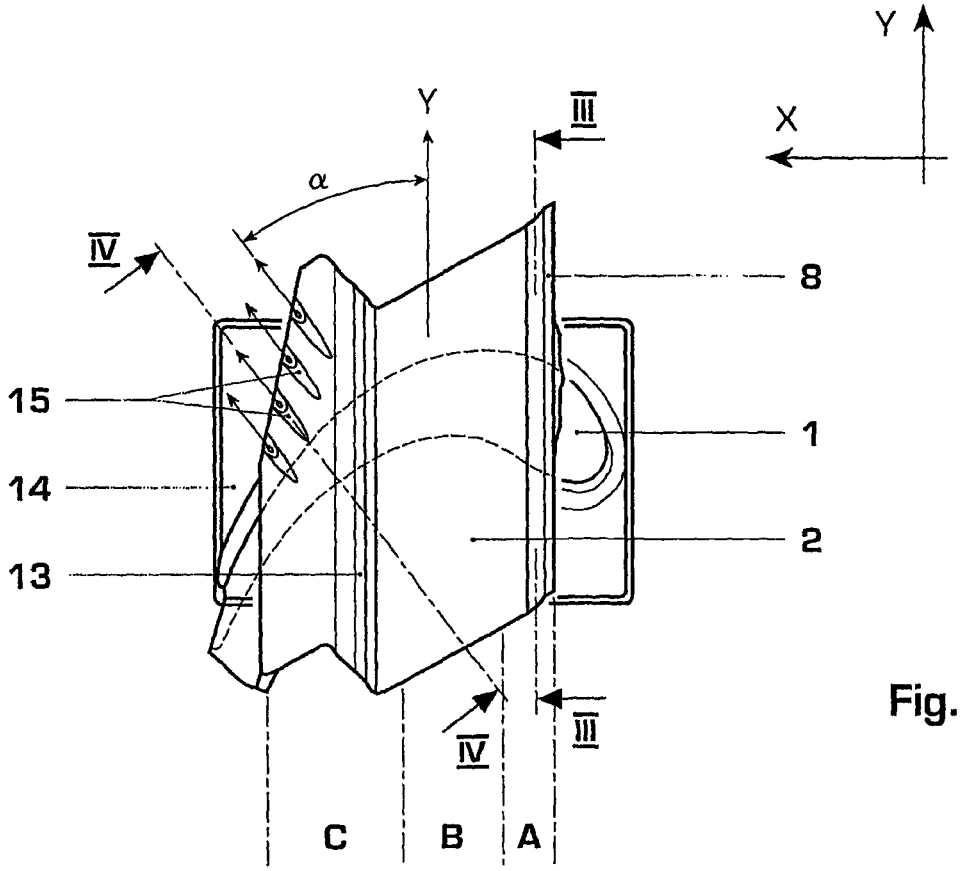
FIG. 2 shows a top view of the shroud of the gas turbine blade.

FIG. 2 shows a top view of the shroud according to the invention, again with the regions A, B, and C. The axial direction and the circumferential direction, with respect to the turbine rotor, are illustrated by x and y, respectively, and also the outline of the blade root 14 is shown and, by broken lines, the outline of the blade itself. The fin 8 in the region A and the fin 13 in the region B are shown, said fins running in the circumferential direction and serving for sealing off against leakage flows. The region C has the bores 15 for the purpose of the convective cooling of that particular region, the bores running at an angle $\alpha$ with respect to the circumferential direction y. The angle $\alpha$ is, for example, in a range of between 2° and 90°. The cooling air which comes out of the bores 15 is blown out in the opposite direction to the direction of rotation of the blade. Preferably, the bores 15 are oriented parallel to one another, so that production is simplified.

FIG. 3 shows a section taken at line III-III in FIG. 2 and shows the fin 8 in the region A of the shroud and the run of the transverse bore 9 and of the bores 10 branching off from the latter. The transverse bore 9 is flow-connected to the cooling system of the blade leaf via the duct 21. The flow connection is ensured by means of an extension of the cooling system of the blade leaf, the extension projecting into the fin 8 and issuing into the transverse bore 9. The plurality of bores 10 branching off run, with respect to the turbine rotor, essentially radially inward to exits on the hot gas side of the fin 8. Arrows indicate the run of the cooling stream through the duct 21 via the transverse bore 9 and the bores 10 branching off. The exits from the bore 10 are configured, in particular, for bringing about film cooling of the fin surface on the hot gas side, for example with a slightly diverging exit portion and a preferred angular range, as is known from the relevant literature. Preferred production methods are the conventional casting methods with a core and also drilling from outside and subsequent closing of the bore entrances by means of stoppers 20 which, for example, are introduced positively or are connected in a materially integral manner (e.g., soldering, welding).

Figure 4:
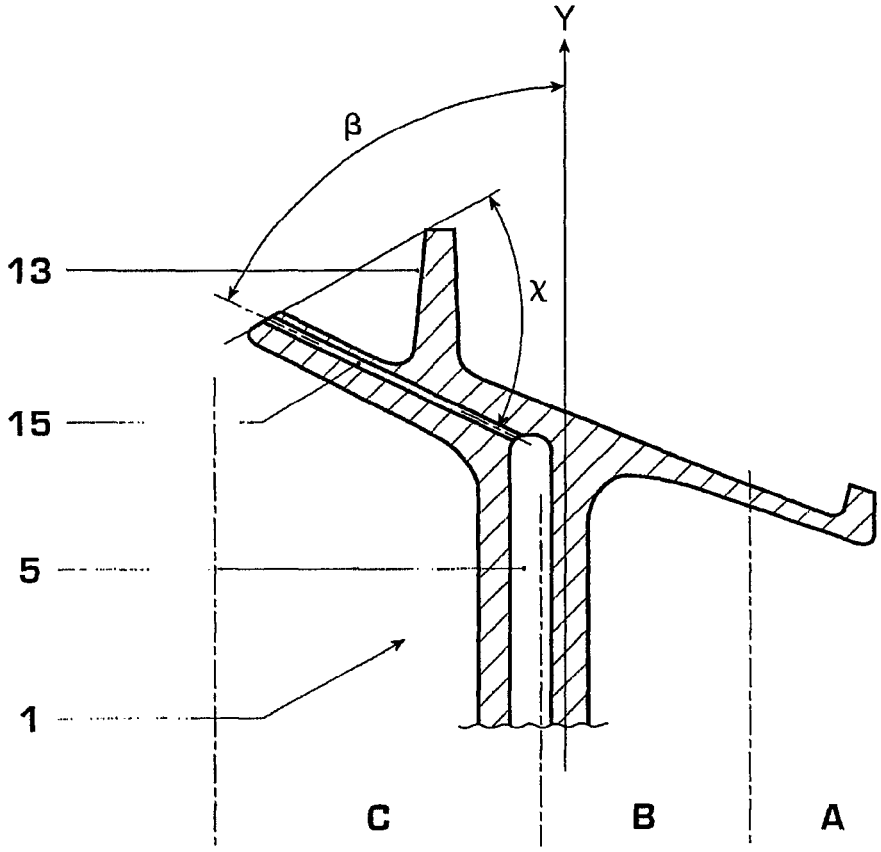
FIG. 4 shows a view of the shroud along the section according to IV-IV to illustrate the cooling bores in the end region of the shroud.

FIG. 4 illustrates in more detail the configuration of the bores 15 in a section taken at line IV-IV. The blade and a duct of the cooling system 5 in its blade leaf are shown. The bore 15 emanates from the duct and extends as far as the radially outer surface of the shroud 2. The exit of a bore 15 has an angled configuration, so that mixing with the hot gas flow can be advantageously influenced according to the conditions. For this purpose, the angle $\chi$ between the exit plane and the axis of the bore is preferably in a range of between 40° and 140°. In addition, the selected angle $\beta$ between the axis of the bore 15 and the radial direction z is preferably in a range of 30° to 120°. The diameter of the bore lies in a range of between 0.6 and 4.5 mm, preferable in a range of between 0.6 and 2.5 mm. This is aimed at an appropriate convective cooling for this region.

Figure 5:
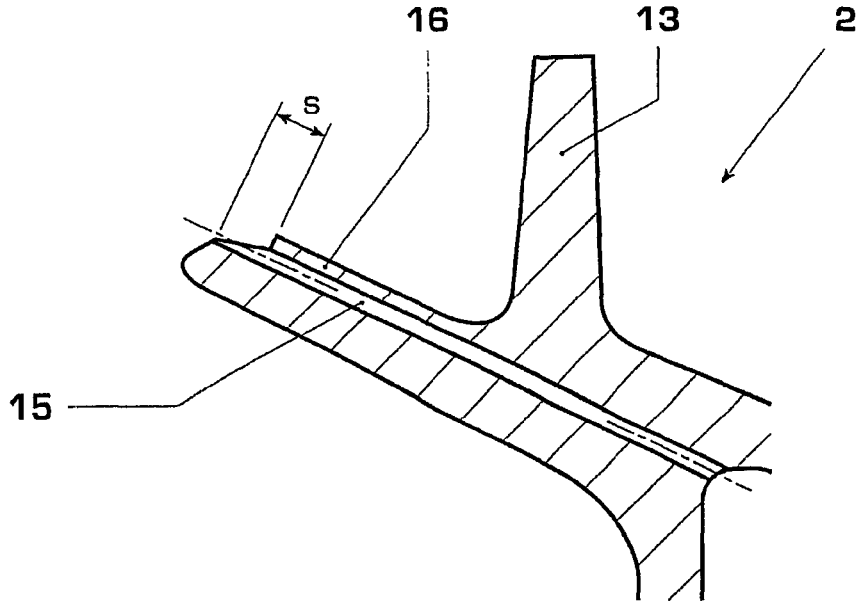
FIG. 5 shows a view of a detail of the end region of the shroud of FIG. 4 to illustrate a preferred exit profile of the cooling bores in the end region.

FIG. 5 shows a variant of the exit of the bores 15 in a section taken at line IV-IV. The exit plane is again angled with respect to the bore axis and stepped, the end of the upper lip 16 being essentially perpendicular to the bore axis. The dimension s is dependent on the diameter of the exit plane and, in particular, is in a ratio to the diameter of the bore in a range of 0.5 to 3, and likewise advantageously makes it possible to influence the mixing with the hot gas flow.

Figure 6:
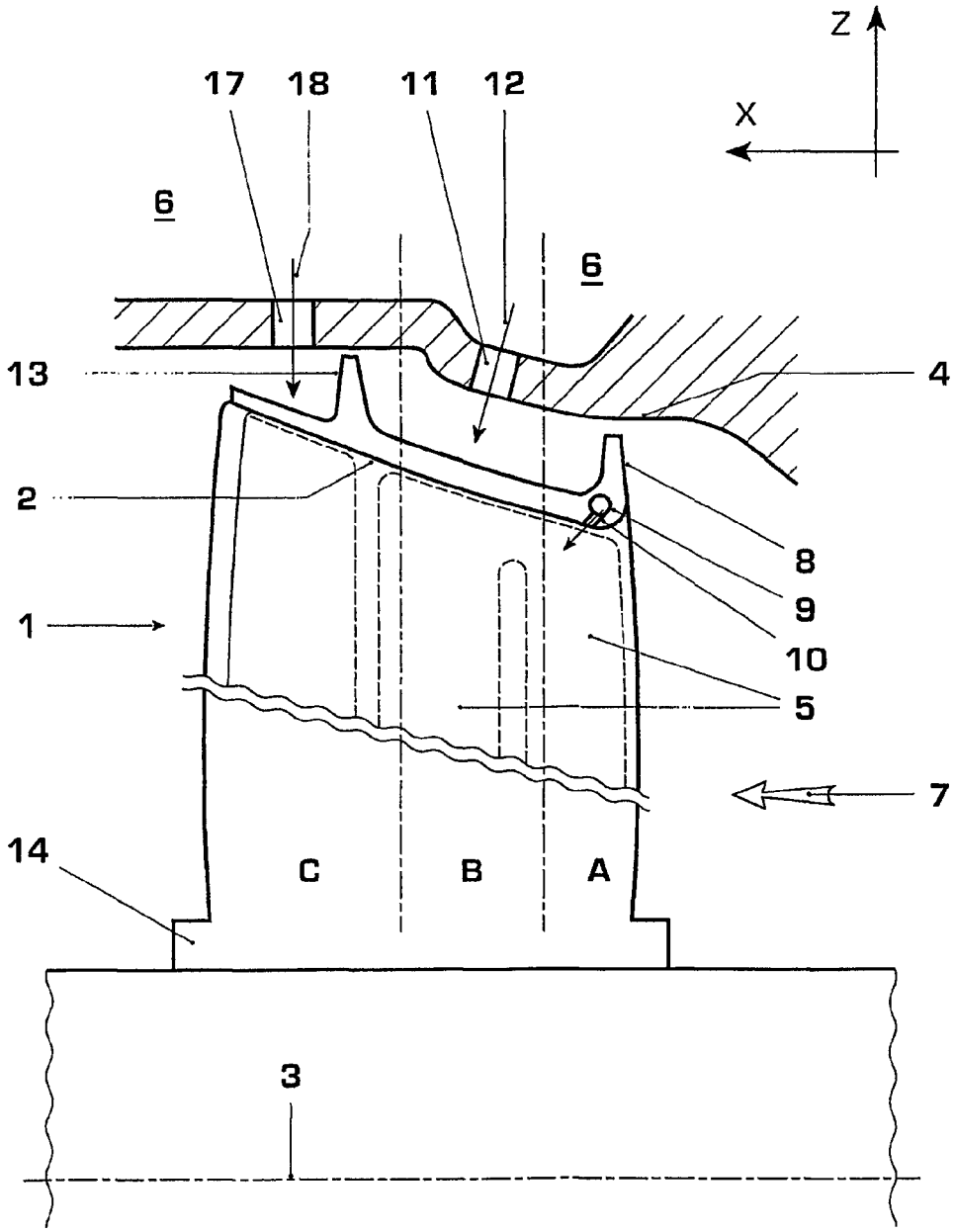
FIG. 6 shows a section through a rotating gas turbine blade, as in FIG. 1, with a cooling arrangement according to the third version of the invention.

FIG. 6 shows, in the same meridional section as in FIG. 1, a gas turbine blade 1 according to the third exemplary version of the invention. Here, in comparison with the first and second versions, instead of the convective cooling of the region C by means of bores from the cooling system of the blade, the stator housing has arranged in it an additional duct, through which cooling air is directed out of the cooling system of the housing to the shroud. Impingement cooling is brought about there, as for the region B.

In a variant of all the versions of the invention, the gas turbine blade is coated with a thermal barrier layer completely or in individual regions according to its use in the gas turbine.

| List of reference symbols | |
|---|---|
| 1 | Blade in a gas turbine |
| 2 | Shroud |
| 3 | Gas turbine rotor |
| 4 | Stator, housing of the gas turbine |
| 5 | Cooling system in the blade (leaf) |
| 6 | Cooling system in the stator |
| 7 | Hot gas flow |
| 8 | First fin |
| 9 | Transverse bore |
| 10 | Bores branching off from the bore 9 and running radially inward |
| 11 | Cooling air duct in the stator |
| 12 | Cooling air stream from the stator |
| 13 | Second fin |
| 14 | Blade root |
| 15 | Bores in the region C |
| 16 | Upper lip of the bores 15 |
| 17 | Cooling air duct |
| 18 | Cooling air stream |
| 20 | Stopper |
| 21 | Duct |
| A | First region of the shroud in the direction of flow of the hot gas |
| B | Second region of the shroud in the direction of flow of the hot gas |

-continued

| List of reference symbols | |
|---|---|
| C | Third region of the shroud in the direction of flow of the hot gas |
| $\alpha$ | Angle between the bores 15 and direction of rotation y |
| $\beta$ | Angle between the axis of the bores and the radial direction z |
| $\chi$ | Angle between the exit plane of the bores 15 and the axis of the bores |
| s | Diameter of the exit plane of the bores 15 |

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A blade and stator system for a gas turbine, the system comprising:

a stator including a stator cooling system;

a blade body including a tip, the blade body including an internal cooling system;

a shroud extending circumferentially along the blade tip;

a first cooling arrangement configured and arranged to cool a first region of the shroud with cooling air from the blade body internal cooling system;

a second cooling arrangement configured and arranged to cool a second region of the shroud with cooling air from the stator cooling system, the second cooling arrangement being arranged in the stator radially opposite the shroud;

wherein the first and second cooling arrangements are configured and arranged to cause cooling of a different type;

wherein the first cooling arrangement is configured and arranged to cause convective cooling and film cooling of the first region of the shroud, and the second cooling arrangement is configured and arranged to cause impingement cooling of the second region of the shroud;

wherein the first region of the shroud is the first region in the direction of the hot gas flow;

wherein said first region includes a first fin which extends radially and circumferentially;

wherein the first cooling arrangement is arranged in the first fin, the first fin having a plurality of bores which are flow-connected to the blade internal cooling system; and wherein the stator includes a stator housing, the stator cooling system is located in the stator housing, and the second cooling arrangement includes, through the stator housing, a cooling duct which is flow-connected to the stator cooling system and directed onto the second region of the shroud.

2. The system as claimed in claim 1, wherein the shroud includes a second fin downstream of said first fin in the direction of the hot gas flow, the second cooling arrangement configured and arranged so that the cooling air stream for the impingement cooling of the second region of the shroud escapes between the first and second fins and the stator housing.

3. The system as claimed in claim 1, wherein the plurality of bores through the first fin each has an exit on the hot gas side of the first fin.

4. The system as claimed in claim 1, wherein the shroud has a radially outer surface and a third region with a third cooling arrangement, the third cooling arrangement having a plurality of bores which are flow-connected to the blade internal cooling system and which extend in an at least partially radially outward direction though the shroud to the radially outer surface of the shroud.

5. The system as claimed in claim 4, wherein the plurality of bores in the third region each has an exit which is directed opposite to the direction of rotation of the blade.

6. The system as claimed in claim 4, wherein the plurality of bores in the third region run parallel to one another.

7. The system as claimed in claim 4, wherein the plurality of bores in the third region extend at an angle with respect to the circumferential direction in a range between 20° and 90°.

8. The system as claimed in claim 4, wherein the plurality of bores in the third region each have an axis and form an exit plane that extends at an angle with respect to the bores' axes in a range between 40° and 140°.

9. The system as claimed in claim 4, wherein the exit plane of the plurality of bores in the third region extends at an angle with respect to the radial direction in a range between 30° and 120°.

10. The system as claimed in claim 4, wherein the shroud has, in the third region, a lip stepped perpendicularly to the exit plane of the plurality of bores, and the ratio of the diameter of each of said plurality of bores over the exit plane to the diameter of said bore is between 0.5 and 3.

11. The system as claimed in claim 1, wherein the shroud has a third region with a third cooling arrangement, wherein the stator includes a stator housing, the stator cooling system is located in the stator housing, the third cooling arrangement has a plurality of cooling ducts flow-connected to the stator cooling system, and the plurality of cooling ducts are directed onto the third region of the shroud.

12. The system as claimed in claim 1, wherein the blade comprises an at least partial thermal barrier layer.

13. A blade and stator system for a gas turbine, the system comprising:

a stator including a stator cooling system;

a blade body including a tip, the blade body including an internal cooling system;

a shroud extending circumferentially along the blade tip;

a first cooling arrangement configured and arranged to cool a first region of the shroud with cooling air from the blade body internal cooling system;

a second cooling arrangement configured and arranged to cool a second region of the shroud with cooling air from the stator cooling system, the second cooling arrangement being arranged in the stator radially opposite the shroud;

wherein the first and second cooling arrangements are configured and arranged to cause cooling of a different type;

wherein the first cooling arrangement is configured and arranged to cause convective cooling and film cooling of the first region of the shroud, and the second cooling arrangement is configured and arranged to cause impingement cooling of the second region of the shroud;

wherein the shroud comprises, in the direction of the hot gas flow, a second fin including an orifice or gap, configured and arranged so that the cooling air stream for the impingement cooling of the second region escapes though the orifice or gap.

* * * * *